United States Patent [19]

Balch

[11] Patent Number: 4,530,421

[45] Date of Patent: Jul. 23, 1985

[54] OIL DRAINAGE AND COLLECTION SYSTEM

[75] Inventor: Duane C. Balch, Napa, Calif.

[73] Assignee: Chartwell Corporation, Napa, Calif.

[21] Appl. No.: 587,228

[22] Filed: Mar. 7, 1984

[51] Int. Cl.[3] ..... F01M 11/04; F16K 51/00

[52] U.S. Cl. ..... 184/1.5; 141/351; 184/88.2; 251/149.6

[58] Field of Search ..... 184/1.5, 88.2, 88 A, 184/105 B; 141/351, 328, 352, 353, 346; 251/149.3, 149.6, 149.7

[56] References Cited

U.S. PATENT DOCUMENTS

| | | | |
|---|---|---|---|
| 1,846,877 | 2/1932 | Knapp . | |
| 1,992,371 | 2/1935 | Hammond et al. | 184/1.5 |
| 2,599,472 | 6/1952 | Miller | 184/105 B |
| 2,680,497 | 6/1954 | Miller | 184/88 A |
| 3,216,527 | 11/1965 | Lewis | 184/1.5 |
| 3,387,621 | 6/1968 | Schaff | 184/1.5 X |
| 3,447,636 | 6/1969 | Bonfilio | 184/1.5 |
| 3,727,638 | 4/1973 | Zaremba et al. | 137/572 |
| 3,871,425 | 3/1975 | Fee et al. | 141/351 X |
| 3,874,478 | 4/1975 | Mantell, Jr. | 184/1.5 |
| 4,033,432 | 7/1977 | Bernstein | 184/1.5 |
| 4,239,184 | 12/1980 | Dudar | 251/149.6 |
| 4,269,237 | 3/1981 | Berger | 141/346 |
| 4,373,561 | 2/1983 | Berger | 141/330 |
| 4,386,639 | 6/1983 | Gable et al. | 141/351 |

*Primary Examiner*—David H. Brown

*Attorney, Agent, or Firm*—James R. Cypher

[57] ABSTRACT

A system for draining and collecting used oil from an engine crank case which includes a drain valve threadably connected to the drain opening in the crank case, a receptacle for receiving the used oil and a valve actuator mounted on the receptacle. The drain valve is formed with an opening which exposes the underface of a spring biased valve member. The valve actuator is formed with a tubular member formed with contact members mounted on the distal end of the tubular member which is inserted into the drain valve opening and move the valve member to an open position so that the used oil drains through the tubular member and into the oil receptacle. The valve actuator is formed with a snap fitting coupler member which holds the oil receptacle to the drain valve while the oil is draining. The drain valve is opened and closed by a simple push or pull on the valve actuator without orientation, turning or threading of any parts. A simple snap closure mounted on the oil receptacle closes the opening in the receptacle.

6 Claims, 7 Drawing Figures

OIL DRAINAGE AND COLLECTION SYSTEM

BACKGROUND OF THE DISCLOSURE

Recyling of used motor oil is a growing but largely unrealized goal. Now that a very high percentage of motorists change their own oil, the problem of collection and return of the used oil to recyling centers has become more difficult. The lack of a clean, quick and efficient system to collect the oil in disposable bags which can be used both by service stations and individual motorists has hampered the attainment of the recyling of a high percentage of used oil. Any system to achieve a high rate of usage must be inexpensive and require no additional equipment which must be cleaned after use and stored. The system, in short, must be totally enclosed and each part must do multiple functions.

Knapp, U.S. Pat. No. 1,846,877, 1982 is a totally enclosed system but requires a long hose, a pump and a semi permanent storage container which is suitable for service stations, but totally inappropriate for individual motorists.

Lewis U.S. Pat. No. 3,216,527, 1965 is a more recent enclosed system, but again it requires a long hose, pump and a large storage container which is suitable only for service stations.

Bonfilio, U.S. Pat. No. 3,447,636, 1983 uses a cartridge system which permits changing of the oil while the vehicle is being operated. The system requires extensive modification of the lubricating system in the vehicle and would be too expensive to adopt except in very specialized situations.

Zaremba, U.S. Pat. No. 3,727,638, 1973 is a totally enclosed system but requires a long hose which would have to be cleaned and stored after each use. In order to open and close the valve, it is necessary to rotate the valve with a wrench which can result in stripped threads if the operator turns the valve the wrong way. Further, the internal valve by its nature would drain the oil very slowly.

Mantell, U.S. Pat. No. 3,874,478 uses a special valve and disposable bag. There are several plugs, spring clips and other parts which could become separated and misplaced resulting in wasted time in changing the oil.

Bernstein, U.S. Pat. No. 4,033,432, 1977 is a novel approach requiring a long hose which is permanently stored in the compartment of the car. It would appear to be a dirty job to fish out the long hose from the inside of the motor compartment in order to attach the end of the hose to the collection bag.

Berger, U.S. Pat. No. 4,269,237, 1981 is a closed system which requires a long hose which is collapsed in a novel way and stored in the container. It is turned inside out and obviously would have to be carefully cleaned before being stored.

Berger U.S. Pat. No. 4,373,561, 1983 is another form of the system illustrated in his earlier patent with a more permanent type of storage container.

Gable, U.S. Pat. No. 4,386,639, 1983 is a closed system utilizing a disposable bag. The system uses a complicated coupling system with a multi-faceted wall which requires a careful fitting and orientation of the coupler over the outside of the specially constructed multi-faceted drain valve and then turning to lock the system in place. The system uses a valve with a spherical surface which would have to be constructed to an exact tolerance to prevent leakage. Further, the system uses caps which could become misplaced and there does not appear to be any easy way of connecting them to prevent separation due to the design of the system.

SUMMARY OF THE DISCLOSURE

The present oil changing system requires no tools or special hoses or other apparatus which can become soiled during the oil changing operation or needs cleaned and stored between oil changes.

The present system is completely enclosed, and when properly used, no used oil will soil any outer surface part of the system, insuring a clean operation.

A valve replaces the standard threaded plug. The valve is constructed so that it is impossible to strip the threads of the crank case opening when threading the valve into the threaded crank case opening.

All fittings are designed for simple snap on, non-twist coupling. There are no threads to strip or parts which require special directional instructions once the valve is installed.

The system has been designed so that the oil change can be accomplshed quickly.

All parts of the system are easily constructed, easily maintained and should provide long lasting trouble free service.

Durable caps are provided for both the valve and the collection bag so that neither can be accidentally opened and dirt and sand particles are prevented from interfering with the operation of the system. All caps are conveniently attached to either the vehicle or the disposable bag and cannot be misplaced or lost.

The system is suitable for use by either individual motorists, or professional oil changing businesses.

The system is designed to make it easier, cleaner and simpler for individuals and businesses to collect and store used oil so that it can be recycled.

DESCRIPTION OF THE PREFERRED EMBODIMENT

Figures 1, 2:
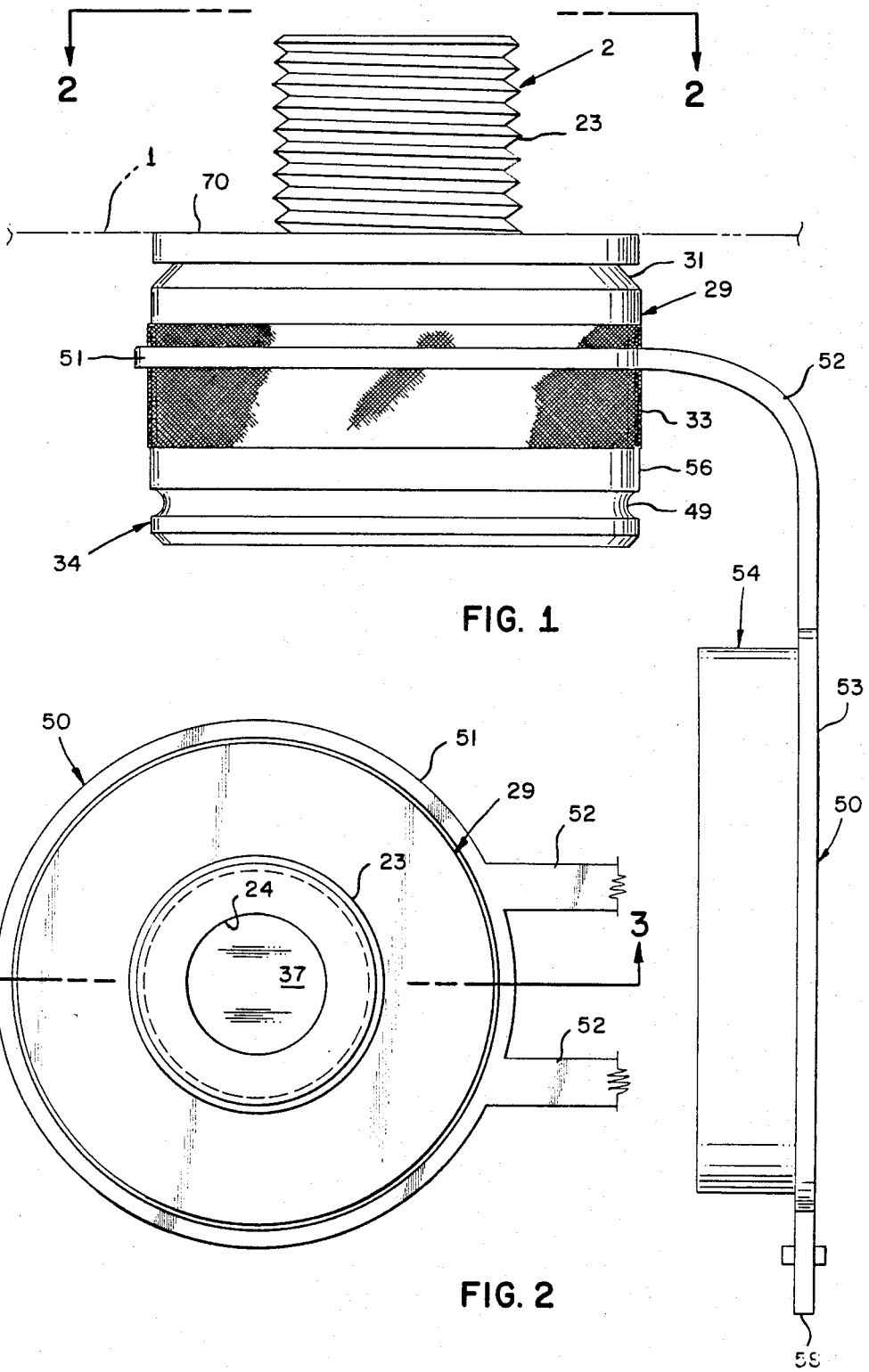
FIG. 1 is a side view of the drain valve of the present invention with the protective cap in the removed position. The phantom line indicates the location of the crank case of a motor.
FIG. 2 is a plan view of the drain valve taken along line 2—2 of FIG. 1.

The present system is designed for draining and collection of used oil from a motor vehicle crank case 1 having a threaded opening. The system includes a drain valve 2 which is threadably connected to the crank case opening. The drain valve consists of a housing 3, a valve chamber 4 formed therein, a valve member 5 mounted in the chamber, a spring means 6 normally biasing the valve member to a closed position, seat means including an O-ring 7 sealably receiving the valve member and a cylindrical internal wall 8 forming a discharge opening operably connected to the valve chamber.

Figure 5:
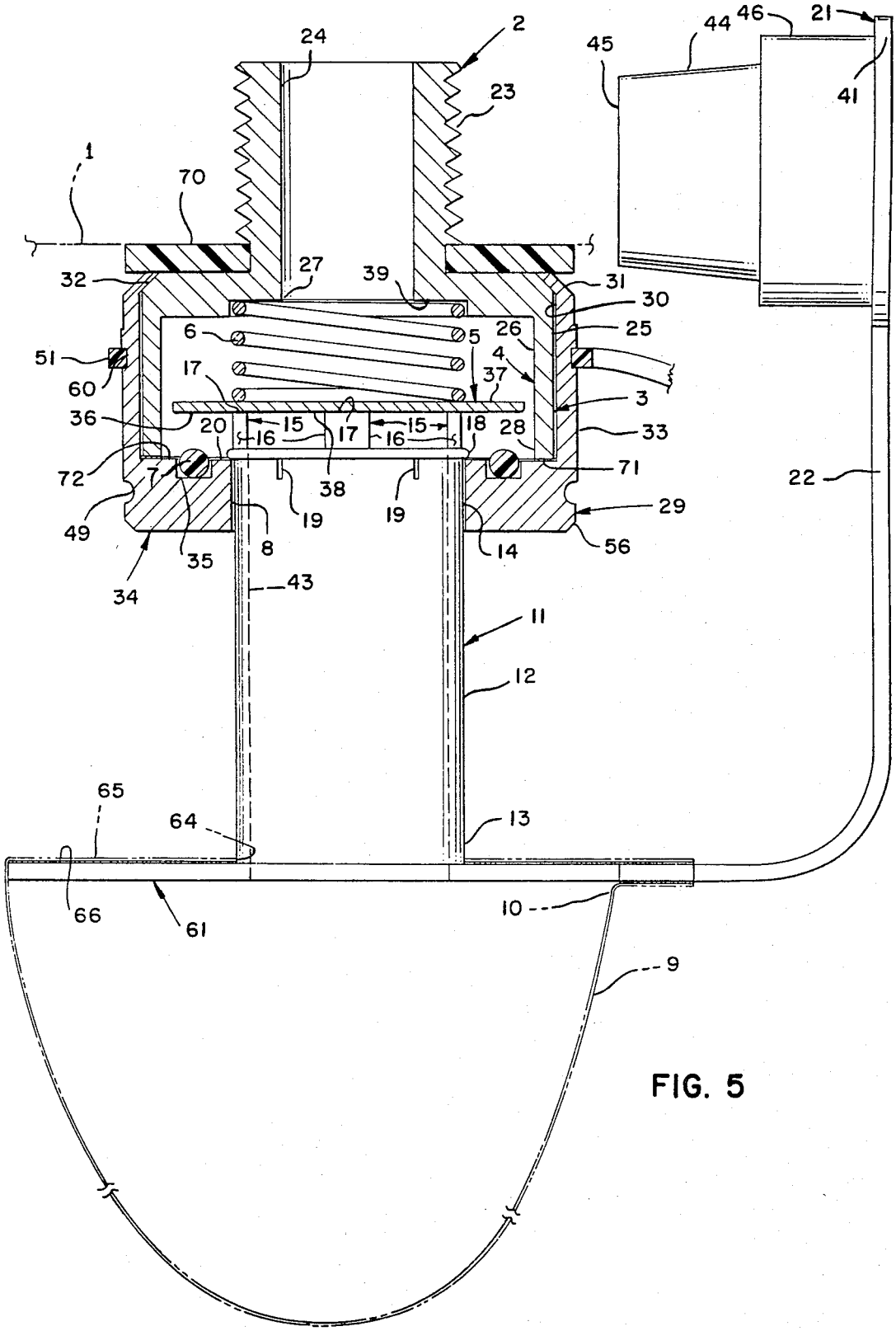
FIG. 5 is a cross section of the valve taken along section line 3—3 of FIG. 2 with the protective cap omitted and the valve actuator inserted into the drain valve and opening the valve member. A portion of the receptacle member and the closure member are shown.
Figure 7:
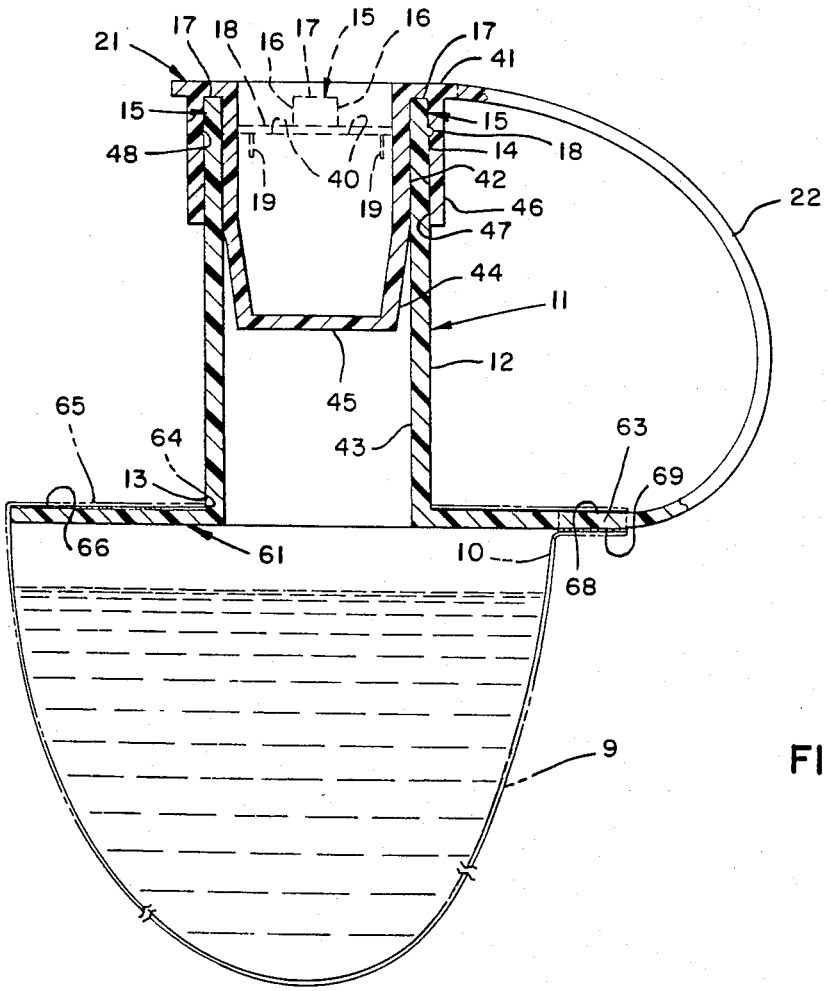
FIG. 7 is a cross section of the valve actuator taken along line 7—7 of FIG. 6. The closure member is shown in its operative position closing the opening in the receptacle.

A receptacle means 9 may be any plastic or metal rigid or flexible container but preferably is a flexible plastic bag which can be folded when not in use. As shown in FIGS. 5 and 7, the flexible bag 9 is formed with an opening 10.

Figure 6:
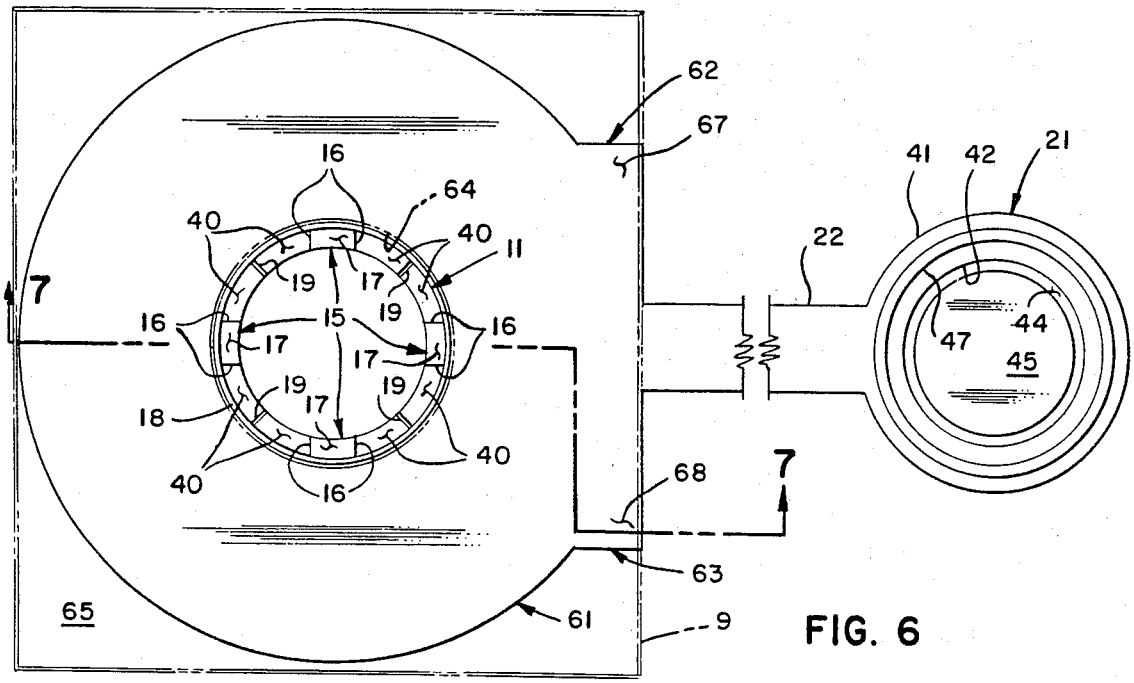
FIG. 6 is a top plan view of the valve actuator and closure member and a portion of the receptacle means.

A valve actuator 11 formed with a tubular member 12 is connected to the receptacle at one end 13 and has a distal end 14 dimensioned for close fitting insertion through the discharge opening in the valve housing. End 13 of tubular member 12 is formed with contact members 15 which engage the valve member 5 for movement against the biasing force of spring 6. As shown in FIGS. 5, 6, and 7, as an example there are four contact members 15, each of which has sides 16 and a top face 17 which contacts valve member 5. The distal end of the tubular member is formed with an annular sealing member 18 which surrounds the tubular member and projects radially outwardly therefrom and forms a seal with the discharge opening. As shown in FIG. 5, the annular sealing member is greater in diameter than the diameter of the discharge opening between cylindrical internal wall 8. In order to permit the tubular member to pass through the discharge opening, a plurality of small longitudinal slots 19 or slot like indentations in the internal side of the internal wall 8 are formed in the distal end 14 of the tubular member which permit the distal end to squeeze together as the tubular member is forced upwardly through the discharge opening. When the annular sealing member 18 clears the top of the opening and passes into valve chamber 4, the distal end of the tubular member expands to its full diameter and the sealing member 18 locks onto annular shoulder 20 adjacent cylinderical wall 8.

As shown in FIG. 5, the annular sealing member 18 forms a coupling means connected to the valve actuator which releasably engages the drain valve 2. Thus, annular member 18 performs the dual function of sealing to prevent the crank case oil from running down the outside wall of tubular member 12 and it locks the actuator member 11 to the drain valve 2.

A closure member 21 for sealably closing the distal end 14 of the tubular member 12 is shown in FIGS. 5, 6 and 7. Preferably, the closure member 21 is connected to the valve actuator 11 by a strand of flexible plastic 22 so that it will not be inadvertently lost or misplaced but will be immediately available for sealing the bag receptacle 9 as soon as the valve actuator is uncoupled from the drain valve 2.

Figure 3:
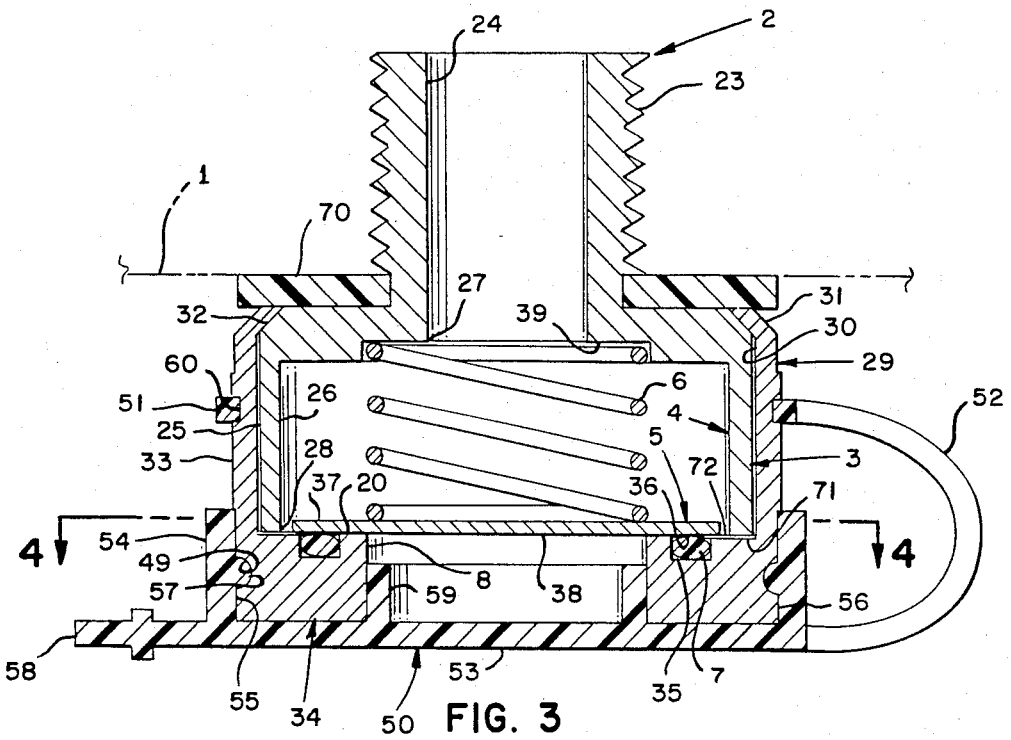
FIG. 3 is a cross sectional view of the drain valve taken along line 3—3 of FIG. 2. The protective cap is shown in its normally operative position engaging the underside of the drain valve.
Figure 4:
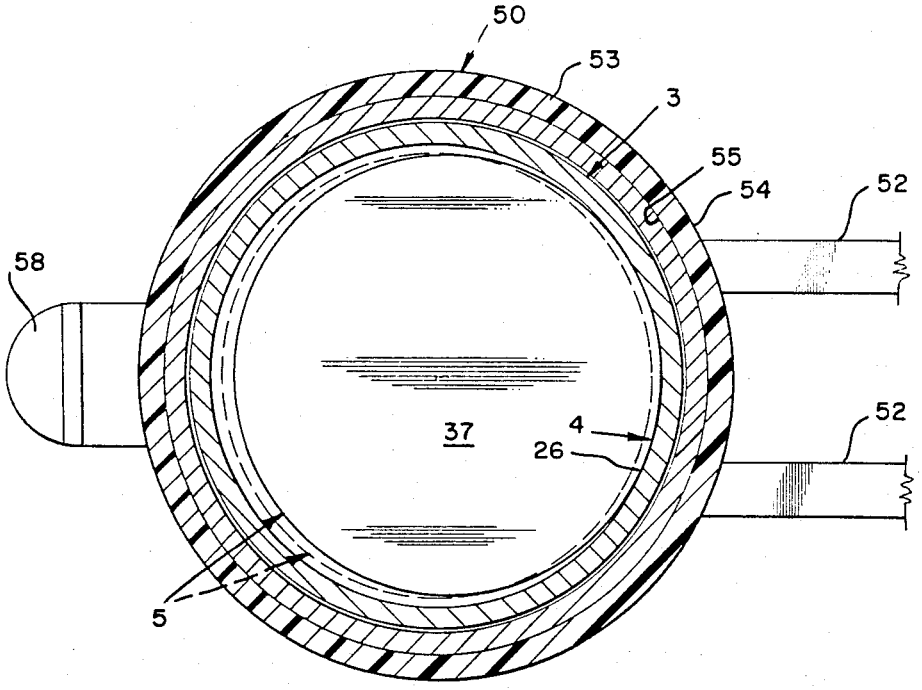
FIG. 4 is a cross section taken along line 4—4 of FIG. 3.

A common problem in installing drain plugs or special drain valves in the crank cases of internal combustion engines is the stripping of the internal threads in the crank case from over tightening the drain plug or drain valve. Special drain plugs with oversize diameters are available for those who strip the threads in the crank case. Rather than furnish a plurality of diameter sizes for the externally threaded portion 23 of the drain valve 2, the present drain valve is constructed in a manner to substantially eliminate any possibility of stripping the crank case threads. As shown in FIGS. 3, 4 and 5, the valve housing is formed with an externally threaded portion 23 as previously mentioned with a passage formed therethrough by internal wall 24. The external threads are threadably connected to the threaded opening in the crank case for receiving oil through the passage. The valve housing is formed with an annular smooth outer wall 25 and an internal wall 26 which defines the internal chamber 4. A first opening 27 connects passage 24 with chamber 4 and internal wall 26 terminates forming a second opening 28.

An annular member 29 having an annular wall 30 is dimensioned for surrounding the housing outer wall 25 in close fitting frictional engagement. The upper end 31 is crimped over sloping shoulder 32 in housing 3 to mechanically hold the annular member 29 to housing 3. In drawing FIGS. 3 and 5, a space is shown between walls 25 and 30 to illustrate that the walls can slip with respect to one another. In fact, in construction there would be little if any actual space between the walls. The walls 25 and 30 are relatively smooth and if the torque force used on knurled face 33 in threadably inserting the drain valve 2 in the threaded opening in the motor crank case exceeds the torque force at which threads 23 will strip the threads in the crank case opening (not shown), slippage will occur between walls 25 and 30 thereby protecting the threaded opening in the crank case.

Annular member 29 is formed with a base member 34 which is formed with cylindrical internal wall 8 which forms a discharge passage in communication with the second opening 28 of valve housing 3. An annular groove 35 in base member 34 opens toward valve chamber 4 in valve housing 3 and surrounds internal wall 8 forming the discharge passage. An annular sealing means such as an O-ring 7 is dimensioned for registration in the annular groove opening. Valve member 5 formed with an annular planar land 36 is dimensioned for selective sealable engagement with the O-ring. Preferably, valve member 5 is a disc having a substantially planar upper surface 37 and a substantially planar lower surface 38.

When the upper and lower surfaces of the valve member are substantially planar, the valve member is free to move horizontally but is dimensioned to always be in sealable contact with the O-ring when in the sealing position and it is also always in contact with compression spring 6. A spring retainer inset 39 centers the spring above O-ring 7 insuring uniform compression on the O-ring.

As shown in FIG. 6, annular sealing member 18 forms a continuous sealing ring protruding radially outwardly from the outer wall of tubular member 12 and is located longitudinally inwardly from the top faces 17 of contact members 15. As shown, annular sealing member 18 extends on the outside face of contact members 15 and extends above the end wall faces 40 of tubular member 12.

The closure member 21 is shown in detail in FIGS. 5, 6 and 7. An annular base 41 is connected to flexible strand member 22. An internal cylindrical wall 42 is connected to the base and has an internal diameter generally equal to or smaller than the diameter of the internal wall 43 of tubular member 12. Wall 42 terminates in a truncated conical wall 44 and closed end 45. The conical wall 44 permits easy insertion of the closure member into tubular member 12. Surrounding wall 42 and co-axially spaced therefrom is annular flange 46 having an inner flange wall 47 for receiving the wall of tubular member 12 therebetween. An annular internal groove 48 is formed in inner flange wall 47 and dimensioned and located for selectively engaging annular protrusion 18 formed on tubular member 12, for snap closing and locking of the closure member on the valve actuator. By carefully forming the closure member and the tubular member to close tolerances in relatively rigid plastic it is very difficult to remove the closure member once it has been locked in place. Thus the used oil cannot be accidentally spilled once the closure is snapped on. Further, flexible strand 22 can be used as a carrying handle for the full bag of used oil because of the locked tight fitting closure member.

It is desirable that the valve opening be protected from dirt and road hazards which might fly up and strike valve member 5. For this purpose, an annular groove 49 is formed in the outside wall of annular member 29. A valve guard 50 formed with an annular ring member 51 dimensioned for close fitting frictional engagement with the outside wall of annular member 29 is formed from a semi-rigid plastic. A hinge member consisting of one or more flexible strands 52 of plastic connect the guard to the ring member. A base member 53 dimensioned for covering the base member 34 of the annular member 29 is formed with a flange wall 54 having an internal wall 55 dimensioned to closely register with the outside wall 56 of annular member 29. Internal wall 55 is formed with an annular protrusion 57 for snap fitting receipt in annular groove 49 formed in annular member 29. A finger engageable extension 58 may be formed as an extension of base member 53 for ease in disengaging the valve guard from the annular member 29. The base member 53 may also be formed with an internal flange wall 59 dimensioned to register with cylindrical internal wall 8. Outside wall 56 may be formed with an annular groove 60 for registered receipt of ring member 51 to prevent separation of the valve guard from the drain valve.

The closure member 21 is connected to the valve actuator 11 as shown in FIGS. 6 and 7. The valve actuator is formed with a flange 61 connected to end 13 of the tubular member 12. The flange may be generally circular in shape with spandrel areas 62 and 63 formed adjacent the strand member 22. An opening 64 is cut or formed in sheet 65 of the receptacle 9 and the tubular member 12 is inserted therethrough. Sheet 65 is then adhered to the top face 66 of flange 61 and the top faces 67 and 68 of spandrels 62 and 63 by a suitable adhesive. The other side of the receptacle is connected to the valve actuator only at the bottom faces of the spandrels 62 and 63 as shown at bottom face 69.

To install the drain valve, the standard drain plug is removed. A drain valve having the same thread size is selected and threadably connected to the crank case. The drain valve is grasped by the knurled face 33 and rotated clockwise until washer 70 is in compression with vehicle crank case 1. If the annular member 29 is torqued too greatly, housing 3 will cease to turn and annular member 29 will turn by slipping at the interface between walls 25 and 30. Relative rotation of annular member 29 and housing 3 does not affect the operation of the valve except that it may be difficult to remove the valve from the crank case should this become necessary.

New oil should be placed in the crank case. The oil cannot drain from the crank case since the pressure exerted by spring 6 against valve member 5 maintains the annular planar land 36 in contact with O-ring 7 as shown in FIG. 3. A washer 71 between the end of internal wall 26 and land 72 of the annular member 29 prevents leakage of oil into the space between walls 25 and 30.

During operation of the engine, valve guard 50 is snapped into place on annular member 29 and held by annular protrusion 57 on flange wall 54 registering in annular groove 49 formed in outside wall 56.

When the oil is to be changed, the valve guard is snapped off by pulling downwardly on finger engageable extension 58. The valve guard swings away as shown in FIG. 1 and is held in place by flexible strands 52 attached to annular ring member 51 which is either frictionally attached to annular member 29 or mechanically engages annular groove 60. The receptacle 9 and valve actuator 11 are grasped in one hand and tubular member 12 is inserted into cylindrical internal wall 8. The distal end 14 compresses radially inwardly as annular protruding sealing member 18 engages the sides of wall 8. The top faces 17 of contact members 15 engage and lift up on the planar lower surface 38 of valve member 5 against the opposed biasing force of spring 6 on planar upper surface 37. As the valve member 5 is lifted, oil in valve chamber 4 passes through the openings between contact members 15 but is prevented from draining due to the seal between annular sealing member 18 and wall 8.

As the tubular member 12 is pushed upwardly, annular sealing member 18 moves above annular shoulder 20 and expands into valve chamber 4. Upward pressure on the tubular member is released and spring 6 immediately forces valve member 5 downwardly against contact members 15 and presses annular sealing member 18 against annular shoulder 20 in sealing contact. Oil immediately passes from the crank case, down the passage formed by internal wall 24, into valve chamber 4, through the passages between contact members 15 and down tubular member 12. The used oil flows into receptacle bag 9 until the crank case is drained. The receptacle bag 9 is sized to receive the full amount of used oil in the crank case.

When all of the oil has drained into the receptacle, the actuator is removed from the drain valve by merely pulling downwardly on the valve actuator 11 by engaging the top face 66 of flange 61. Tolerances and materials of the valve actuator are selected so that when the valve actuator is locked in place, the coupling effect of annular seal 18 resting on shoulder 20 will support a full bag of used oil even though the receptacle 9 is supported only by the seal 18 resting on shoulder 20.

As the valve actuator is withdrawn, spring 6 presses down on valve member 5 and forces the valve closed by pressing the valve member 5 against O-ring 7. As annular seal 18 moves downwardly, it presses against wall 8 preventing the leaking of used oil. The length of wall 8 is selected so that valve member 5 seals against O-ring 7 before seal 18 clears wall 8. It is to be noted that the mechanical locking of sealing member 18 on shoulder 20 is greater than the force of spring 6.

As soon as the tubular member is removed from the valve member, closure member 21 is forced into engagement with tubular member 12. Specifically, truncated conical wall 44 is inserted into internal wall 43 of tubular member 12. The closure member is forced downwardly until internal groove 48 in annular flange 46 engages annular sealing member 18 in distal end 14 of tubular member 12.

It is not intended that the closure member 21 be removed from tubular member 12. To empty the contents of bag receptacle 9 into a recycle barrel or tank, a knife blade can simply puncture the side of receptacle bag 9 and the used oil drained through the slash in the bag.

The valve guard 50 is then pressed onto the base member 34 of annular member 29 until annular protrusion 57 engages groove 49. New oil is now ready to be poured into the crank case.

I claim:

1. A system for draining and collecting used oil from an engine crank case having a threaded opening comprising:

a. a drain valve threadably connected to said crank case opening having a housing, a valve chamber formed therein, a valve member mounted in said chamber, spring means normally biasing said valve member to a closed position, seat means sealably receiving said valve member and an internal cylindrical wall forming a discharge opening operably connected to said valve chamber;

b. receptacle means dimensioned for receiving the used oil from said crank case and formed with an opening therein;

c. a valve actuator formed with a tubular member connected to said receptacle means at one end and having a distal end dimensioned for close fitting insertion through said discharge opening in said valve housing and having a contact member connected to said distal end of said tubular member for engaging said valve member for movement against said spring means, and formed with an annular sealing member surrounding said tubular member which forms a coupling and a seal with said discharge opening; and d. a closure member for sealably closing said distal end of said tubular member.

2. A system for draining and collecting used crank case oil from an engine crank case having a threaded opening comprising:

a. a valve housing formed with an externally threaded portion and a passage therethrough threadably connected to said crank case threaded opening for receiving oil through said passage and formed with an annular outer wall and an internal wall defining an internal chamber having a first opening operatively connected to said passage and a second opening;

b. an annular member having an annular wall dimensioned for surrounding said housing outer wall in close fitting engagement and a base member connected to said annular wall and formed with a cylindrical internal wall forming a discharge passage in communication with said second opening of said valve housing, and said annular member is formed with an annular groove, opening toward said valve chamber in said valve housing and surrounding said internal wall forming said cylindrical discharge passage;

c. annular sealing means dimensioned for registration in said annular grove in said annular member;

d. a valve member formed with an annular planar land dimensioned for selective sealable engagement with said annular sealing means and mounted within said internal chamber of said valve housing;

e. biasing means mounted in said valve housing internal chamber biasing said valve member to a closed position;

f. receptacle means dimensioned for receiving the used oil from said crank case and formed with an opening therein;

g. a valve actuator formed with a tubular member connected to said receptacle at one end and having a distal end dimensioned for closed fitting insertion through said cylindrical discharge passage in said annular member and having a contact member connected to said distal end of said tubular member for engaging said valve member for movement against said biasing means, and formed with an annular sealing member forming a seal and coupling with said cylindrical discharge passage in said annular member; and h. a closure member dimensioned for selectively closing said distal end of said tubular member.

3. A system as described in claim 2 comprising:

a. said annular member is formed with an annular groove in said outside of said annular wall; and b. a valve guard formed with an annular ring member dimensioned for close fitting frictional engagement with said outside wall of said annular member, a hinge member connected to said annular ring and a base member dimensioned for covering said base member of said annular member and a flange wall surrounding said annular wall of said annular member and formed with an annular protrusion in said flange wall for snap fitting receipt in said annular groove in said outside of said annular wall of said annular member.

4. A system as described in claim 2 wherein:

a. said valve member is a circular disc having upper and lower planar lands; and b. said closure member includes a flexible strand member connecting said closure member to said valve actuator.

5. A system as described in claim 4 wherein:

a. said annular member is formed with an annular shoulder adjacent said cylindrical discharge passage; and b. said sealing member of said valve actuator and said coupling means are combined in an annular protrusion extending radially outwardly from said tubular member adjacent and longitudinally inwardly from said contact member and dimensioned from sealing and coupling engagement with said annular shoulder of said annular member.

6. A system as described in claim 4 comprising:

a. said contact member consists of a plurality of protrusions extending from said tubular member and said tubular member is formed with a plurality of annularly spaced slots adjacent said distal end of said tubular member; and b. said closure member is formed with an inner cylindrical wall terminating in a tapered internal annular wall and a closed end dimensioned for selected insertion into said tubular member of said valve actuator and an annular flange wall surrounding and spaced from said inner cylindrical wall and formed with an annular sealing member dimensioned and located for selectively engaging said annular sealing member on said tubular member for snap closing and locking of said closure member on said valve actuator.

* * * * *